US010538290B2

(12) United States Patent
Hildreth

(10) Patent No.: US 10,538,290 B2
(45) Date of Patent: Jan. 21, 2020

(54) ADAPTABLE WEATHERPROOF VENTILATION SYSTEM

(71) Applicant: Bradley B. Hildreth, Garden City, NY (US)

(72) Inventor: Bradley B. Hildreth, Garden City, NY (US)

(73) Assignee: Bradley B. Hildreth, Garden City, NY (US)

( * ) Notice: Subject to any disclaimer, the term of this patent is extended or adjusted under 35 U.S.C. 154(b) by 0 days.

(21) Appl. No.: 15/997,237

(22) Filed: Jun. 4, 2018

(65) Prior Publication Data

US 2018/0346072 A1 Dec. 6, 2018

Related U.S. Application Data

(60) Provisional application No. 62/514,320, filed on Jun. 2, 2017.

(51) Int. Cl.
*B63B 17/02* (2006.01)

(52) U.S. Cl.
CPC ..... *B63B 17/023* (2013.01); *B63B 17/02* (2013.01)

(58) Field of Classification Search
CPC ..... B63B 17/00; B63B 17/02; B63B 17/023; B63B 19/00; B63B 19/04; B63B 19/06; B63B 19/14; B63B 19/28; B63J 2/00
USPC ..... 114/201 R, 203, 211
See application file for complete search history.

(56) References Cited

U.S. PATENT DOCUMENTS

| | | | | |
|---|---|---|---|---|
| 4,941,422 | A * | 7/1990 | Muller | B63B 17/02 114/201 R |
| 5,022,339 | A | 6/1991 | Baskin | |
| 5,339,759 | A | 8/1994 | Peabody | |
| 5,588,386 | A * | 12/1996 | Schilt | B63J 2/04 114/211 |
| 6,289,834 | B1 * | 9/2001 | Phillips | B63J 2/04 114/211 |
| 2008/0156243 | A1 | 7/2008 | Jeffries | |

OTHER PUBLICATIONS

ATN, Inc. ATN Products Dorcap Canvas Vent and Dorade, Web Page, pp. 1-6, www.atninc.com/atn-dorcap-sailing-deck-gear.shtml (undated).

* cited by examiner

*Primary Examiner* — Lars A Olson
(74) *Attorney, Agent, or Firm* — Hoffmann & Baron, LLP

(57) ABSTRACT

A weatherproof ventilation system that provides protection from rain and waves entering the hold of a boat or ship while allowing fresh air to reach areas below the deck. The adaptable weatherproof ventilation system is positioned over a hatch and includes a flexible structure, a support structure, a flat bottom section, a folding baffle, and a removable baffle. The weatherproof ventilation system has an opening and arrangement of baffles that is adjustably controlled by the folding baffle and the removable baffle. The weatherproof ventilation system can also comprise one or more loops, one or more elastic cords, a skirt, first and second poles, and one or more snaps, zippers, straps, buckles, and ropes for attachment of the weatherproof ventilation system to the deck of the boat or ship.

20 Claims, 4 Drawing Sheets

ADAPTABLE WEATHERPROOF VENTILATION SYSTEM

This application claims priority from provisional application Ser. No. 62/514,320, filed on Jun. 2, 2017, which is incorporated herein in its entirety.

BACKGROUND OF THE INVENTION

The present invention is in the technical field of protective covers that provide ventilation through hatches or other openings. More particularly, the present invention is in the technical field of protective covers that provide ventilation while preventing water intrusion.

The holds or below decks of boats and ships require ventilation to maintain a comfortable level of fresh air. The hatches in the decks of the ships and boats allow fresh air to enter the holds but also can allow rain and waves into the hold. This is especially true for small boats with decks only a few feet above the waterline. A variety of wind shields and screens have been used to reduce the amount of water entering the hold but, for the most part, they have proven to be unsatisfactory. Therefore, there is a need for device that allows fresh air to enter the hold of a boat or ship, while preventing unwanted rain and spray from wave action from entering the hold.

SUMMARY OF THE INVENTION

The present invention is a weatherproof ventilation system or hood for installation over a hatch in a deck of a boat or a ship. The weatherproof ventilation system or hood comprises, consists of or consists essentially of: a flexible structure, a support structure, a flat bottom section, a folding baffle, and a removable baffle. The weatherproof ventilation system or hood can also comprise one or more loops, one or more elastic cords, a skirt, first and second poles, and one or more snaps, zippers, straps, buckles, and ropes for attachment of the weatherproof ventilation system to the deck of the boat or ship.

The flexible structure has a top side, a bottom side and a perimetrical edge and is positioned over the support structure, which includes one or more curved ribs having an inverted U-shape or one or more ribs formed in three sections with a top member with opposing ends and two parallel side members extending at right angles from the opposing ends. The support structure supports the flexible structure to provide a rear wall and two side walls that extend downwardly from the top side to the perimetrical edge and form an interior and an opening having a first height on a fourth side. The perimetrical edge of the flexible structure is adapted to lie flat on the deck of the boat or ship.

The flat bottom section has a front, a rear, and first and second sides. The bottom section is attached to the two side walls with the front located at the opening and the rear located at the edge of the hatch or into the interior. The folding baffle is attached along its length to the bottom section and extends between, and is connected to, the two side walls. The sides of the folding baffle are connected to the side walls along their entire lengths, with excess material, preferably attached to the side walls at a 45 degree angle slanting forward, to allow folding while maintaining complete waterproof integrity when upright or at any degree of folding. The folding baffle can be adjustably positioned with respect to the bottom section at an angle of between 0 and 90 degrees to adjust the flow of air passing through the interior, with 0 degrees being fully folded in a forward position. Preferably, the folding baffle is at either 0 or approximately 90 degrees. To facilitate this, one or more elastic cords are used to tension the folding baffle into an upright position, and one or more pairs of Velcro™, snaps, zippers, or tie points are used to hold the folding baffle into the lowered position, with enough strength to overcome the tension provided by the elastic cords. As used herein, the term Velcro™ refers to a fastener formed by two strips of thin plastic sheet, one covered with tiny loops and the other with tiny flexible hooks, which adhere when pressed together and can be separated when pulled apart. When the folding baffle is positioned at an angle of 90 degrees, it has a second height equal to at least one-quarter, preferably at least one half of the first height of the opening of the weatherproof ventilation system.

The removable baffle is removably attached to the flexible structure and extends over the opening and downwardly for a fixed or adjustable distance from the top of the flexible structure to the bottom section. The removable baffle can be attached to the flexible structure by snaps, zippers, Velcro™, buckles, straps, or rope. The weatherproof ventilation system or hood can also include a skirt that extends from the perimetrical edge of the flexible structure to the front and sides of the hatch opening or into the interior. Preferably, the skirt extends from the perimetrical edge of the rear wall into the interior.

The weatherproof ventilation system or hood can also include one or more loops attached to or formed as part of the flexible structure and one or more elastic cords attached to the one or more loops for securing the flexible structure to the deck of the boat or ship. The weatherproof ventilation system or hood can also include a first pole extending along and fastened to the perimetrical edge of the rear wall and a second pole positioned below the deck and attached to the first pole to secure the weatherproof ventilation system to the deck. The first pole can be attached to the second pole by straps, elastic cords, ropes or any other fastening device that provides tension between the two poles to secure the first pole to the deck of the boat or ship. The tension between these two poles, in combination with tension on the forward-most loops, is sufficient to allow and maintain the forward and aft shape of the weatherproof ventilation system, even in the absence of any internal support structure, such as forward and aft rods.

The weatherproof ventilation system or hood can also include one or more loops formed as part of the flexible structure or attached to the underside of the flexible structure to hold the structure in place when folded, such folding being possible in to the absence of forward and aft facing rods or other support structure.

BRIEF DESCRIPTION OF THE DRAWINGS

The preferred embodiments of the adaptable weatherproof ventilation system or hood of the present invention, as well as other objects, features and advantages of this invention, will be apparent from the accompanying drawings wherein.

DETAILED DESCRIPTION OF THE INVENTION

The adaptable weatherproof ventilation system or hood of the present invention is a portable, collapsible hood for allowing airflow while blocking rain and spray, including horizontally moving water such as rain during strong winds or spray from wave action during a storm, while also being able to allow the flow of air. The hood uses a pair of removable or folding baffles to adjust the amount of rain or spray protection versus the amount of desired airflow. The hood mounts on boat hatches or other openings without requiring any modifications to the host structure or any special mounting hardware. The hood can be folded flat, with the arrangement of a portion of the hood's bottom and the hood's baffles forming a streamlined exposure to wind. The hood can use a hatch hinge as a mounting point and has rope attachment points to use tension from pre-existing deck hardware to keep the hood's shape and position.

The adaptable weatherproof ventilation system provides protection from rain and waves entering the hold of a boat or ship while allowing fresh air to reach areas below the deck. The adaptable weatherproof ventilation system is positioned over a hatch and includes a hood on three sides and an opening on the fourth side. The open side has a bottom section or floor that lies flat on the deck and extends from the opening into the interior of the hood and connects to a folding baffle that extends upwardly into the interior. The folding baffle can be adjustably positioned at an angle of between zero degrees, where it lies flat on the bottom section towards the opening of the hood in order to provide maximum airflow, to an angle of approximately 90 degrees from the deck, where it extends upwardly in order to provide maximum protection from rain or waves entering the hatch. The folding baffle can be held in the 90 degree upright position by one or more elastic cords tensioned towards the rear of the hood, and held in the 0 degree flat position by Velcro™, snaps, zippers, or tie points between the folding baffle and the bottom of the flexible ventilation system.

The adaptable weatherproof ventilation system also includes a removable baffle that is removably attached to the top and sides of the hood and extends an adjustable distance over the opening. The removable baffle can be attached to the hood by snaps, zippers, Velcro™, buckles, straps, rope or any other fastening means known to those skilled in the art. The removable baffle and the folding baffle are used to adjust the size of the opening in the adaptable weatherproof ventilation system to provide fresh air to flow through the hatch in a variety of different weather conditions, from rough seas and heavy rain to calm seas on a clear day.

As used herein, the term "hatch" refers to an opening, with or without a cover or door, in the deck of a boat or ship leading to a cabin or a lower level below the deck, especially a hold.

Figure 1:
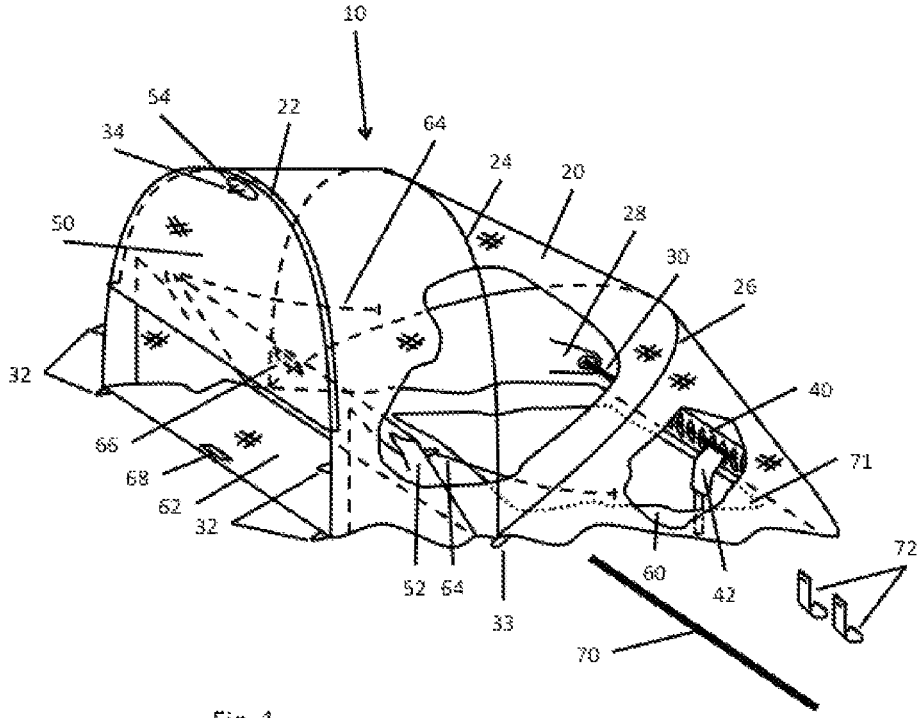
FIG. 1 is a perspective view of the present invention.

Referring now to the invention in more detail, in FIG. 1 the hood 10 has a collapsible hood top 20 supported by one or more hoops 22, 24, 26. The hoops are attached to the hood top to support the hood top in an open state as shown in FIG. 1. The hood top 20 is further supported at one end by a pole 30, and at an opposite end by ropes (not shown) attached to loops 32 and loop 34 to maintain the hood 10 in a non-collapsed state. The ropes are further attached to existing deck hardware to provide needed tension. Tension from pole 30 is exerted upon both sides of hood top 20 at reinforced areas 28. The hood top 20 is further held in place by straps 40, which are attached to hood top 20. Straps 40 wrap around pole 30, except where straps 42 wrap around pole 30 in order to hold pole 30 down onto the deck. Straps 42, typically used in pairs although one is shown, are attached to the underside of the hood top 20 by a pole 70 that extends below the hatch opening 71, across the entire hatch opening 71. Hooks 72 can be used to grab the underside edge of the hatch opening 71, and may be used either in combination with pole 70 or without pole 70. More than one set of poles 70 or hooks 72 may be used to keep the hood 10 firmly attached to the deck, either at the hatch hinge or elsewhere around the hatch opening. These are tensioned using buckles or other means. In typical use, pole 30 is kept in place by being trapped on the outside of the hatch and hatch lid and held against the hatch hinges by straps 42, which run between the hatch and the hatch lid and exert inward pressure against pole 30. This makes for a very firm attachment and supports the use of tension to keep the shape and position of the hood relative to the hatch.

In further detail, still referring to the invention of FIG. 1, airflow enters the hood 10 from the opening below removable baffle 50 and above the bottom 62 of the hood 10. Water intrusion is prevented primarily by removable baffle 50 and folding baffle 52. The path that airflow must take is first low, below baffle 50, and then elevated inside the hood 10 to allow gravity to remove rain or spray such that they do not proceed over folding baffle 52. To further this effect, when folding baffle 52 is in the upright position, the bottom of removable baffle 50 is located at a lower altitude than the top of folding baffle 52, and folding baffle 52 is located after (i.e. downstream of) removable baffle 50 in terms of airflow. Removable baffle 50 fits around loop 34 and inside of small baffle 54, rather than covering loop 34, to allow tension to remain in effect while attaching and detaching removable baffle 50. A small opening in removable baffle 50 facilitates its wrapping around loop 34. This small opening is kept closed during use by VELCRO®, zipper, snaps or other means. During use, removable baffle 50 is held in place against the rest of the hood 10 by VELCRO®, zippers, snaps or other means. Small baffle 54 is mounted onto the mid-point of loop 43, and when removable baffle 50 is in place, it is external to small baffle 54. In this manner, small baffle 54 prevents water intrusion into the small opening made in removable baffle 50 through which loop 34 protrudes. In typical use, removable baffle 50 can be detached from the rest of the hood 10 and foldable baffle 52 can be folded down against the bottom 62 of the hood 10 to allow for uninhibited airflow when rain and spray are not present. Further, only one of those measures can be taken so that either baffle is solely in place, according to the risk of inclement weather or spray.

In further detail, still referring to the hood 10 of FIG. 1, folding baffle 52 is held in the upright position by elastic cords 64 which are attached near the top of folding baffle 52 and then to the inside of hood top 20. These cords 64 are slightly stretched when folding baffle 52 is upright, to hold folding baffle 52 in that position. Elastic cords 64 are significantly more stretched when folding baffle 52 is folded down against the bottom 62 of the hood 10, to facilitate raising the folding baffle to the upright position. When it is desired to have folding baffle 52 in the down position, a pair of VELCRO® attachments 66 and 68 hold the baffle 52 down and prevent elastic cords 64 from pulling the folding baffle 52 back into the upright position. Other attachment means can also be used, such as but not limited to snaps, buttons or zippers.

In further detail, still referring to the hood 10 of FIG. 1, a skirt 60 runs around the hatch opening 71 to prevent water intrusion from all sides and to help channel airflow down the hatch. An adjustable drawstring within skirt 60 keeps skirt 60 firmly against the sides of the hatch opening, which typically has a small lip that can be used for this purpose.

Figure 2:
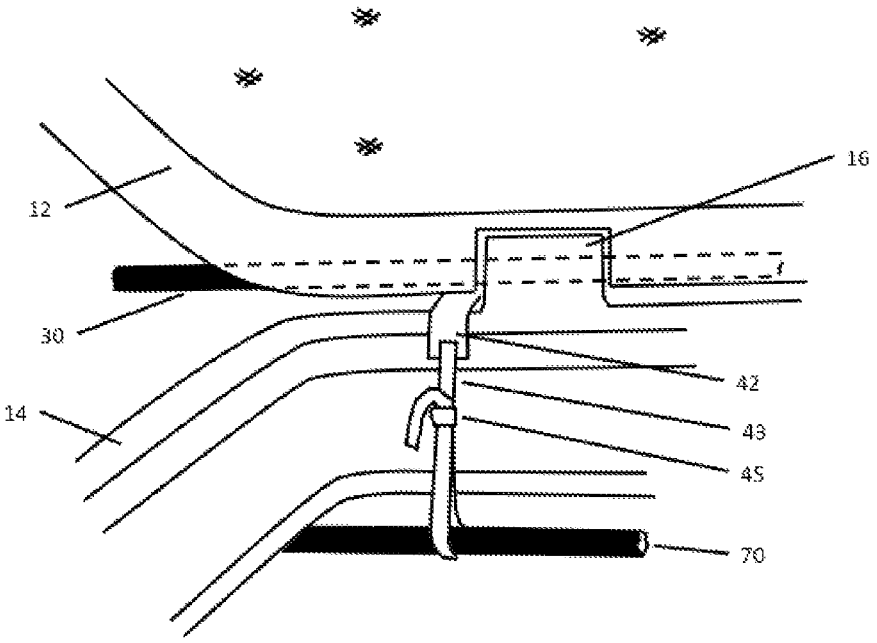
FIG. 2 is a perspective view of the inside of FIG. 1, showing the attachment method, with hatch door included in the figure.
Figure 3:
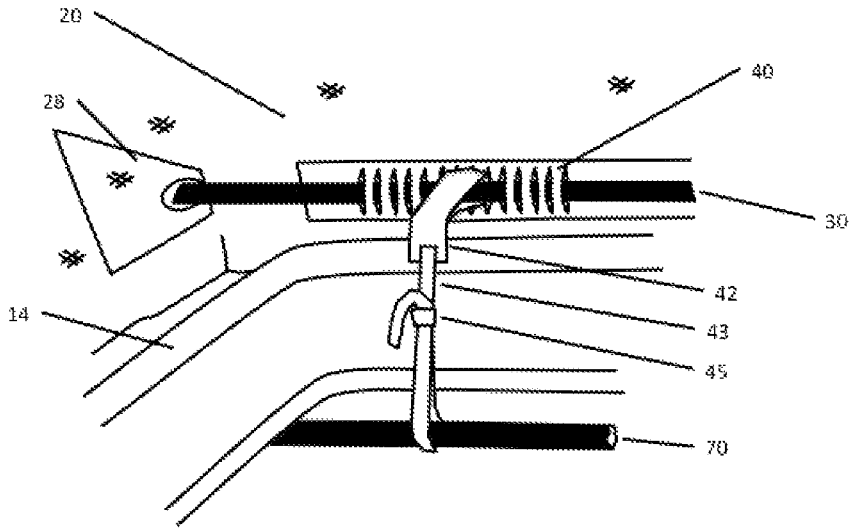
FIG. 3 is a perspective view of the inside of FIG. 1, showing the attachment method, with hatch door not shown.

Referring now to FIGS. 2 and 3, which show more detailed views of FIG. 1, straps 42 wrap around pole 30 to keep in firmly in place against the hatch hinge or hinges 16, and enters into the inside of the hatch opening between the hatch base 14 and hatch lid 12. Straps 42 thus firmly affix the position of pole 30. Straps 42 can also be positioned snug against the sides of the hinge or hinges 16, to hold pole 30 even more firmly in place against wind loads on either side of the hood 10. As pole 30 is held in place against the hinge or hinges 16, straps 42 allow pole 30 to be used as a point of tension, first at the reinforced areas 28 at either side of the top 20 of the hood 10, and thence throughout the hood 10 and to the ropes tied to the loops 32 and 34. Straps 42 must necessarily be thin enough to let the hatch lid 12 close firmly against hatch base 14 in the closed position. Straps 42 are therefore built wide enough to support the needed tension in spite of its thinness. Affixed to straps 42 are straps 43, which are more standard straps that can be used with buckles or tensioning arrangements 45 to exert tension against pole 70. Pole 70 is thus the source of the tension used to keep pole 30 and the rest of the hood 10 in place, and to keep the forward and aft shape of the hood even in the absence of any poles along the side walls. As previously mentioned, hooks can be substituted for the use of pole 70, and more than one arrangement of poles and hooks can be used for the purpose of holding the hood 10 in place, either at the hatch hinge or elsewhere around the hatch opening. A series of small straps 40 mounted onto the top 20 of the hood 10 allows straps 42 to wrap around pole 30 where needed along pole 30, and also allows top 20 to be held against pole 30 in all other locations along the length of pole 30. This arrangement allows for great flexibility in the positioning of straps 42 along the length of pole 30 to accommodate hatches of different widths and various hinge locations, while also holding top 20 down and preventing airflow from spilling out of the hood 10 in this area. In typical use, a grommet or other reinforcement is mounted onto reinforced areas 28, where pole 30 enters reinforced area 28, said grommet being large enough for pole 30 to enter into it. A hitch pin, cotter pin, or other means is used near the end of pole 30 to keep it from sliding out of reinforced area 28, in spite of any buffeting winds that may occur to the overall hood 10.

Figure 4:
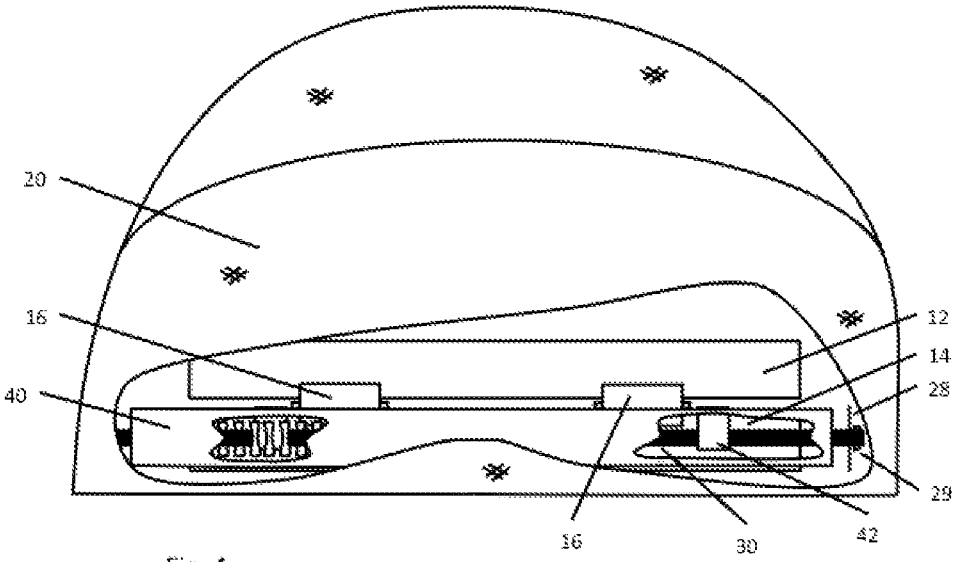
FIG. 4 is a view of the rear of FIG. 1, with a portion of the cover cut away and with other portions removed.

Referring now to FIG. 4, which shows a more detailed, rear view of FIG. 1 with the hatch shown closed, top 20 is attached to a series of straps 40. Straps 40 surround pole 30 to keep pole 30 firmly attached to top 20, except at the locations where straps 42 surrounds pole 30 for the purpose of tensioning pole 30 firmly against hinge or hinges 16 and for the purpose of holding the hood 10 firmly down onto the deck. Straps 42 wrap around pole 30 and thence between the hatch lid 12 and hatch base 14. This allows hood top 20 to completely enclose the hatch base 14 and hatch lid 12, preventing water intrusion from all directions. Pole 30 goes through reinforced areas 28 and supports tension throughout the hood 10. On each side, hitch pins, cotter pins or other means 29 prevent pole 30 from slipping out of reinforced areas 28.

Figure 5:
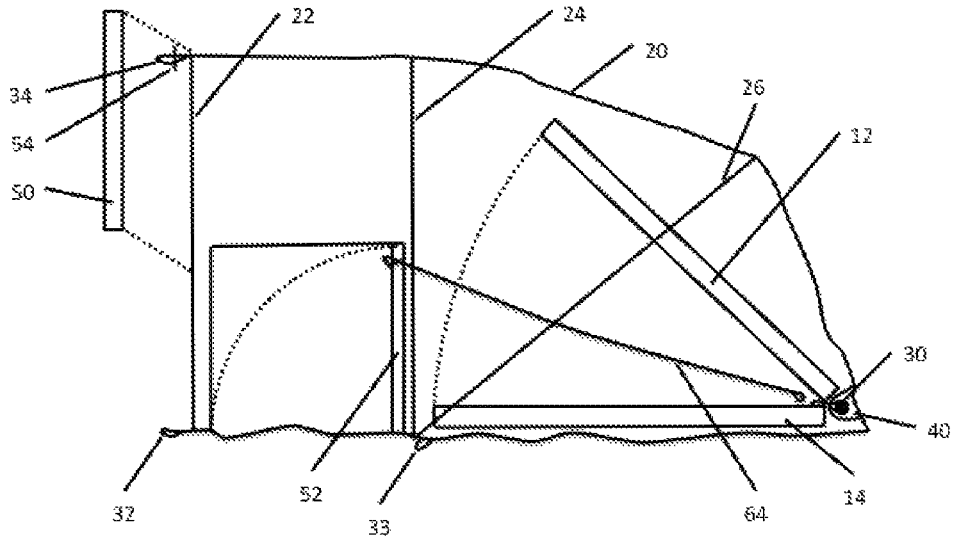
FIG. 5 is a side view of FIG. 1, with all of the top fabric removed except for a thin line at the very top.

Referring now to FIG. 5, which shows a more detailed, side view of FIG. 1, the arc of travel of hatch lid 12 is shown, as is the arc of travel of folding baffle 52. Elastic cords 64 attach to folding baffle 52 and to the sides of hood top 20. Small baffle 54 is attached to the midpoint of loop 34, so that it blocks any water flow where removable baffle 50 wraps around loop 34. Removable baffle 50 is thus attached behind small baffle 54 when in use. Hoop 26 is shown at an optimal angle for supporting hood top 20 while also allowing hatch lid 12 to be raised a significant amount, thus allowing for a large amount of airflow over folding baffle 52 and down into the hatch opening.

Figure 6:
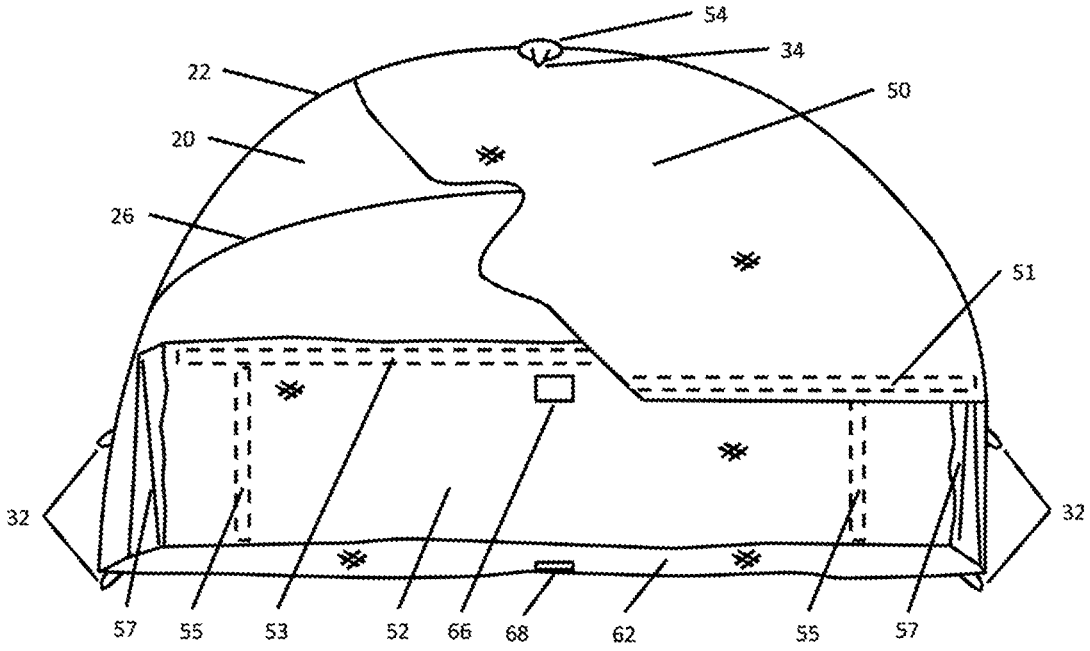
FIG. 6 is a perspective view of the front of FIG. 1, with the lower baffle in the upright position.

Referring now to FIG. 6, which shows a more detailed, front view of FIG. 1, removable baffle 50 is shown in place, with a cut away to show detail behind it. Folding baffle 52 is shown in the upright position. The inside of hood top 20 and hoop 26 are shown. The front edge of hood top 20 is located at hoop 22. Small baffle 54 is located in front of removable baffle 50, as is a portion of loop 34. In typical use, one or more of loop 34 and loops 32 would have one or more ropes attached to provide tension to keep the hood 10 in an upright position, and ensure its overall shape and effectiveness. Reinforcing rods 53, 55 are within folding baffle 52 and serve to keep the shape of folding baffle 52 when large amounts of water are forced against it, such as in a storm. Typically, reinforcing rod 53 would be located near the top of folding baffle 52. Reinforcing rods 53, 55 can be located in various arrangements and positions within folding baffle 52. Stitch lines 57 show the typical 45 degree stitching along the sides of folding baffle 52, which secure folding baffle 52 to hood top 20 with watertight integrity, while still allowing folding baffle 52 to fold into its lowered position against the bottom 62 of the hood 10. Stitch lines 57 also serve to support folding baffle 52 when folding baffle 52 is in the upright position and large amounts of water are forced against it. Stitching above stitch line 57 is avoided, to facilitate folding. Reinforcing rod 51 is inside removable baffle 50 and serves to keep the shape of removable baffle 50 when large amounts of water are forced against it, such as in a storm.

Figure 7:
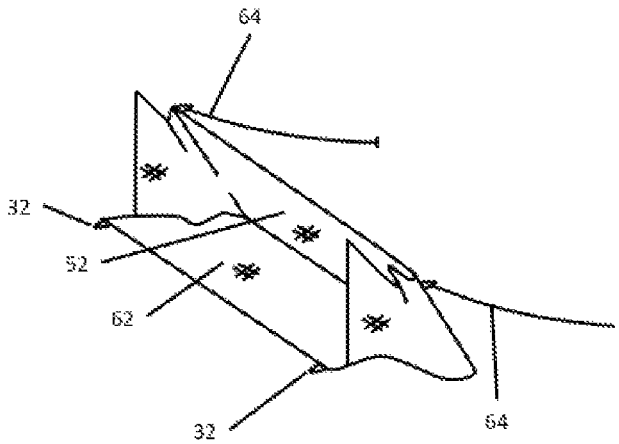
FIG. 7 is a perspective view of the lower baffle of FIG. 1, with all top fabric removed and the lower baffle partially folded down.

Referring now to FIG. 7, which shows a more detailed view of a portion of FIG. 1, folding baffle 52 is shown in perspective view, without other components of the design. Folding baffle 52 is shown partially folded. The ends or sides of folding baffle 52 wrap around to form sides as seen, and the length of each end or side is affixed to the side of hood top 20 to form a waterproof seal. The length of the bottom of folding baffle 52 is affixed to the bottom 62 of the hood 10, to form a waterproof seal. The sides thus formed are attached to the top of the hood 10 and support folding baffle 52 when large amounts of water are forced against it. Finally, elastic cords 64 ensure that folding baffle 52 remains upright when desired.

Figure 8:
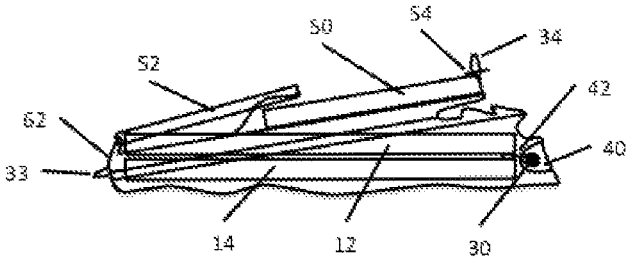
FIG. 8 is a side view of FIG. 1, with the hood shown in a folded position, and with all of the top fabric removed except for a thin line that is at the very top when unfolded.

Referring now to FIG. 8, which shows a more detailed view of a portion of FIG. 1, the hood 10 can be folded to form a streamlined exposure to the wind. This allows, in the case of a ship-borne installation, an immediate increase in visibility over the deck, to meet a crisis such as a slipping anchor or a drifting boat that is headed for impact. When folded, the bottom 62 of the hood 10 meets folding baffle 52, which covers the lower portion of removable baffle 50, allowing no large opening of the hood 10 to be exposed to the wind, which would otherwise compromise the folded configuration. Loops 33 on each side are used to hold the folded form in place and can retain at least a modicum of tension along the base of the hood 10 to reinforced areas 28 and pole 30, in order to keep the hood 10 on the deck. In typical use, loops 33 are roped directly or otherwise secured to existing deck hardware for this purpose, whereas other loops that are attached to tensioning ropes may be attached through a means for quick release, such as snaps or buckles, thus facilitating rapid folding of the hood 10. To initiate folding of the hood 10, folding baffle 52 is first placed in the lowered position, so that once the hood 10 is folded, folding baffle 52 covers the bottom of removable baffle 50 to help prevent air from entering the hood 10 and to keep the hood 10 streamlined. In the folded configuration, hatch lid 12 is typically lowered in advance and perhaps secured to hatch base 14. There remains the arrangement of tension through straps 42 to keep pole 30 in place, and tension between pole 30 and loops 33 keep the overall hood 10 in place. After the need for increased visibility is over, such as when the vessel is once again anchored, pulling on loop 34 unfolds the hood 10 and the hood 10 can be easily attached to tensioning ropes as before.

As much of this design depends on tension, more hoops or fewer hoops than shown can be used without affecting the design and its effectiveness.

The construction details of the invention as shown in FIG. 1 are the top 20, bottom 62, and baffles 50, 52, 54 may be made out of waterproof material such as but not limited to canvas, plastic, vinyl, acrylic, Eisenglass, or coated nylon. Hoops 22, 24, 26 may be made of a flexible substance such as but not limited to fiberglass or thin steel, or of any other sufficiently flexible and strong material. The reinforcing rods 53, 55 may be made of fiberglass, wood, aluminum, or of any other sufficiently rigid and strong material. Further, the various components of the hood 10 can be made of different materials.

The advantages of the hood include, without limitation, allowing fresh air into a boat to prevent mildew when the occupants of the boat are away, without having to worry about rain or spray destroying the contents of the boat. Further, occupants of the boat can enjoy fresh air during periods of rain or spray. This is especially important in the tropics, where the heat in an enclosed boat can be miserable and stifling. Further, the device can be quickly folded flat to allow for visibility when needed, such as when moving the boat in order to reset a drifting anchor. The device is portable and adaptable to different hatch sizes, and can be stored or shipped either in a tube or a flat box. As the top of the device is continuously on the outside of the hatch, water intrusion is greatly prevented. The arrangement of straps and poles secured around hatch hinges offers a very secure mounting method, which is needed to withstand storms, especially when the boat is unoccupied and unmonitored.

In a broad embodiment, the hood is a hooped structure containing folding or removable baffles, with a skirt to prevent wind from escaping around the hatch, with attachments around the hatch's hinge that support tension, and with multiple straps to prevent wind from escaping near the hinge, while being configurable for different sized openings or hatches.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. A weatherproof ventilation system for installation over a hatch in a deck of a boat or a ship, the weatherproof ventilation system comprising:

a flexible structure having a top side, a bottom side and a perimetrical edge;

a support structure comprising one or more curved ribs having an inverted U-shape or one or more ribs formed in three sections with a top member with opposing ends and two parallel side members extending at right angles from the opposing ends, wherein the support structure supports the flexible structure to provide a rear wall and two side walls that extend downwardly from the top side to the perimetrical edge and form an interior and an opening on a fourth side, the opening having a first height;

a flat bottom section having a front, a rear, and first and second sides, wherein the bottom section is attached to the two side walls with the front located at the opening and the rear located in the interior;

a folding baffle attached to the rear of the bottom section and extending between, and connected to, the two side walls, wherein the folding baffle is adjustably positioned with respect to the bottom section at an angle of between 0 and 90 degrees; and a removable baffle removably attached to the flexible structure and extending over the opening and downwardly for a fixed or adjustable distance from the top of the flexible structure to the bottom section.

2. The weatherproof ventilation system according to claim 1, further comprising one or more loops in the flexible structure for attachment of the flexible structure to the boat or ship.

3. The weatherproof ventilation system according to claim 2, further comprising one or more cords attached to the one or more loops to secure the weatherproof ventilation system to the deck of the boat or ship.

4. The weatherproof ventilation system according to claim 1, further comprising a skirt extending from the perimetrical edge of the rear wall into the interior.

5. The weatherproof ventilation system according to claim 1, further comprising a first pole extending along and fastened to the perimetrical edge of the rear wall.

6. The weatherproof ventilation system according to claim 5, further comprising a second pole positioned below the deck and attached to the first pole to secure the weatherproof ventilation system to the deck.

7. The weatherproof ventilation system according to claim 6, wherein the first pole is attached to the second pole by straps, elastic cords, or ropes.

8. The weatherproof ventilation system according to claim 1, wherein the removable baffle is attached to the flexible structure by snaps, zippers, buckles, straps, ropes, or a fastener formed by two strips of thin plastic sheet, one covered with loops and the other with flexible hooks, which adhere when pressed together and can be separated when pulled apart.

9. The weatherproof ventilation system according to claim 1, wherein, when the folding baffle is positioned at an angle of 90 degrees, it has a second height equal to at least one-quarter of the first height.

10. The weatherproof ventilation system according to claim 1, wherein, when the folding baffle is positioned at an angle of 90 degrees, it has a second height equal to at least one-half of the first height.

11. A weatherproof ventilation system for installation over a hatch in a deck of a boat or a ship, the weatherproof ventilation system comprising:

a flexible structure having a top side, a bottom side and a perimetrical edge;

a support structure comprising one or more curved ribs having an inverted U-shape or one or more ribs formed in three sections with a top member with opposing ends and two parallel side members extending at right angles from the opposing ends, wherein the support structure supports the flexible structure to provide a rear wall and two side walls that extend downwardly from the top side to the perimetrical edge and form an interior and an opening on a fourth side, the opening having a first height;

a flat bottom section having a front, a rear, and first and second sides, wherein the bottom section is attached to the two side walls with the front located at the opening and the rear located in the interior;

a skirt extending from the perimetrical edge of the rear wall into the interior;

a folding baffle attached to the rear of the bottom section and extending between, and connected to, the two side walls, wherein the folding baffle is adjustably positioned with respect to the bottom section at an angle of between 0 and 90 degrees, and wherein, when the folding baffle is positioned at an angle of 90 degrees, it has a second height equal to at least one-quarter of the first height; and a removable baffle removably attached to the flexible structure and extending over the opening and downwardly for a fixed or adjustable distance from the top of the flexible structure to the bottom section.

12. The weatherproof ventilation system according to claim 11, further comprising one or more loops in the flexible structure and one or more ropes, straps, or elastic cords attached to the one or more loops to secure the weatherproof ventilation system to the deck of the boat or ship.

13. The weatherproof ventilation system according to claim 11, further comprising a first pole extending along and fastened to the perimetrical edge of the rear wall and a second pole positioned below the deck and attached to the first pole to secure the weatherproof ventilation system to the deck.

14. The weatherproof ventilation system according to claim 13, wherein the first pole is attached to the second pole by straps, elastic cords, or ropes.

15. The weatherproof ventilation system according to claim 11, wherein the removable baffle is attached to the flexible structure by snaps, zippers, buckles, straps, ropes, or a fastener formed by two strips of thin plastic sheet, one covered with loops and the other with flexible hooks, which adhere when pressed together and can be separated when pulled apart.

16. A weatherproof ventilation system for installation over a hatch in a deck of a boat or a ship, the weatherproof ventilation system comprising:

a flexible structure having a top side, a bottom side and a perimetrical edge;

a support structure comprising one or more curved ribs having an inverted U-shape or one or more ribs formed in three sections with a top member with opposing ends and two parallel side members extending at right angles from the opposing ends, wherein the support structure supports the flexible structure to provide a rear wall and two side walls that extend downwardly from the top side to the perimetrical edge and form an interior and an opening on a fourth side, the opening having a first height;

a flat bottom section having a front, a rear, and first and second sides, wherein the bottom section is attached to the two side walls with the front located at the opening and the rear located in the interior;

a first pole extending along and fastened to the perimetrical edge of the rear wall;

a second pole positioned below the deck and attached to the first pole to secure the weatherproof ventilation system to the deck;

a folding baffle attached to the rear of the bottom section and extending between, and connected to, the two side walls, wherein the folding baffle is adjustably positioned with respect to the bottom section at an angle of between 0 and 90 degrees, and wherein, when the folding baffle is positioned at an angle of 90 degrees, it has a second height equal to at least one-quarter of the first height; and a removable baffle removably attached to the flexible structure and extending over the opening and downwardly for a fixed or adjustable distance from the top of the flexible structure to the bottom section.

17. The weatherproof ventilation system according to claim 16, further comprising a skirt extending from the perimetrical edge of the rear wall into the interior.

18. The weatherproof ventilation system according to claim 16, further comprising one or more loops in the flexible structure and one or more ropes, straps or elastic cords attached to the one or more loops to secure the weatherproof ventilation system to the deck of the boat or ship.

19. The weatherproof ventilation system according to claim 16, wherein the first pole is attached to the second pole by straps, elastic cords, or ropes.

20. The weatherproof ventilation system according to claim 16, wherein the removable baffle is attached to the flexible structure by snaps, zippers, buckles, straps, ropes, or a fastener formed by two strips of thin plastic sheet, one covered with loops and the other with flexible hooks, which adhere when pressed together and can be separated when pulled apart.

* * * * *